US005706596A

United States Patent [19]

How

[11] Patent Number: 5,706,596

[45] Date of Patent: Jan. 13, 1998

[54] DISPLAY HAVING ROTATABLE ARTICLES

[76] Inventor: Chin-Jung How, 58, Ma Yuan West St., Taichung, Taiwan

[21] Appl. No.: 629,615

[22] Filed: Apr. 9, 1996

[51] Int. Cl.[6] ..... G09F 19/08

[52] U.S. Cl. ..... 40/414; 446/265; 446/236

[58] Field of Search ..... 446/242, 265, 446/236, 297, 303, 357, 358; 40/414, 411, 456, 453, 473

[56] References Cited

U.S. PATENT DOCUMENTS 5,226,845 7/1993 Wu ..... 446/265

5,459,278 10/1995 Hsu ..... 446/303 X

*Primary Examiner*—Mickey Yu

[57] ABSTRACT

A display having a spectacle shell, and a rotary mechanism disposed in the spectacle shell. A first doll is disposed on the outer periphery of the spectacle shell. A second doll is disposed above the spectacle shell. A middle disk is disposed on the spectacle shell. The middle disk is enclosed by a middle disk casing. An upper disk casing which encloses an upper disk is disposed on the middle disk casing. A third doll is disposed on the upper disk casing. A plurality of dolls are disposed on the middle disk casing. The rotary mechanism includes a plurality of gears and shafts to rotate the corresponding dolls.

1 Claim, 4 Drawing Sheets

DISPLAY HAVING ROTATABLE ARTICLES

BACKGROUND OF THE INVENTION

The present invention relates to a rotary toy. More particularly, the invention relates to a rotary toy with a plurality of rotary articles.

Most conventional toy device cannot be rotated with two or more articles thereon. It is difficult to rotate an article on a toy. It is very difficult to rotate a plurality of articles on a toy also.

SUMMARY OF THE INVENTION

An object of the invention is to provide a rotary toy in order to rotate a plurality of articles thereon.

Another object of the invention is to provide a rotary toy with at least an article rotating transversely and at least another article rotating longitudinally.

Accordingly, a rotary toy comprises a spectacle shell and a rotary mechanism disposed in the spectacle shell. A first doll is disposed on the outer periphery of the spectacle shell. A second doll is disposed above the spectacle shell. A middle disk is disposed on the spectacle shell. The middle disk is enclosed by a middle disk casing. An upper disk casing which encloses an upper disk is disposed on the middle disk casing. A plurality of dolls are disposed on the upper and middle disk casings. The rotary mechanism comprises a plurality of gears and shafts to rotate the corresponding dolls. The rotary mechanism comprises a housing which is covered by the spectacle shell, a base plate disposed beneath the housing, and a gear set, an integrated circuit board and a cell chamber disposed in the interior between the base plate and the housing. The rotary mechanism comprises a motor disposed on the base plate, and a transverse plate abutting a top of the motor and supported by a plurality of posts longitudinally. The posts are extended upward from the base plate. A switch, an integrated circuit board, a cell chamber and a loudspeaker are disposed on the base plate. The motor has a driving shaft. A driving disk is disposed on a top end of the driving shaft. A first, second, third, and fourth driven shafts are extended upward from the base plate longitudinally. A fifth and sixth driven shafts are extended upward from the transverse plate longitudinally. A seventh, eighth, ninth, and tenth driven shafts are extended upward from the cell chamber longitudinally. The eleventh driven shaft is extended forward from the cell chamber transversely. The first driven shaft passes through the transverse plate. A driven disk is disposed on a top end of the first driven shaft. A belt surrounds the driving disk and the first driven disk. A first pinion is disposed at a middle portion of the first driven shaft. A first gear is disposed at an upper portion of the second driven shaft. A second pinion is disposed at a top end of the second driven shaft. A second gear is disposed at a top end of the third driven shaft. The fourth driven shaft passes through the transverse plate. A third pinion is disposed at a middle portion of the fourth driven shaft. A third gear is disposed at a top end of the fourth driven shaft. The fifth driven shaft passes through a gear wheel, the transverse plate, a fourth gear, a driven cylinder, the middle disk, and the upper disk. A fifth gear is disposed at a top end of the sixth driven shaft. A sixth gear is disposed at a top end of the seventh driven shaft. A seventh gear is disposed at a top end of the eighth driven shaft. An eighth gear is disposed at a lower portion of the ninth driven shaft. A ninth gear is disposed at a top end of the tenth driven shaft. A tenth gear is disposed at a rear end of the eleventh driven shaft. The housing has a first through hole to receive the ninth driven shaft and a second through hole to receive the eleventh driven shaft. The first doll is supported by a front end of the eleventh driven shaft. The second doll is supported by an upper portion of the ninth driven shaft. The first pinion intermeshes with the first gear. The first gear intermeshes with the second gear. The second gear intermeshes with the third pinion. The third gear intermeshes with the fourth gear. The gear wheel intermeshes with the second pinion. The fourth gear intermeshes with the fifth gear. The fifth gear intermeshes with the sixth gear. The sixth gear intermeshes with the seventh gear and the ninth gear. The seventh gear intermeshes with the eighth gear. The ninth gear intermeshes with the tenth gear. In operation, the driving disk of the motor drives the belt to rotate the driven disk and the first pinion. The first pinion drives the first gear and the second pinion to rotate. The first gear drives the second gear to rotate. The second gear drives the third pinion and the third gear to rotate. The third gear drives the fourth gear to rotate. The fourth gear drives the fifth gear to rotate. The fifth gear drives the sixth gear to rotate. The sixth gear drives the seventh gear and the ninth gear to rotate. The seventh gear drives the eighth gear to rotate. The ninth gear drives the tenth gear to rotate.

DETAILED DESCRIPTION OF THE INVENTION

Figure 1:
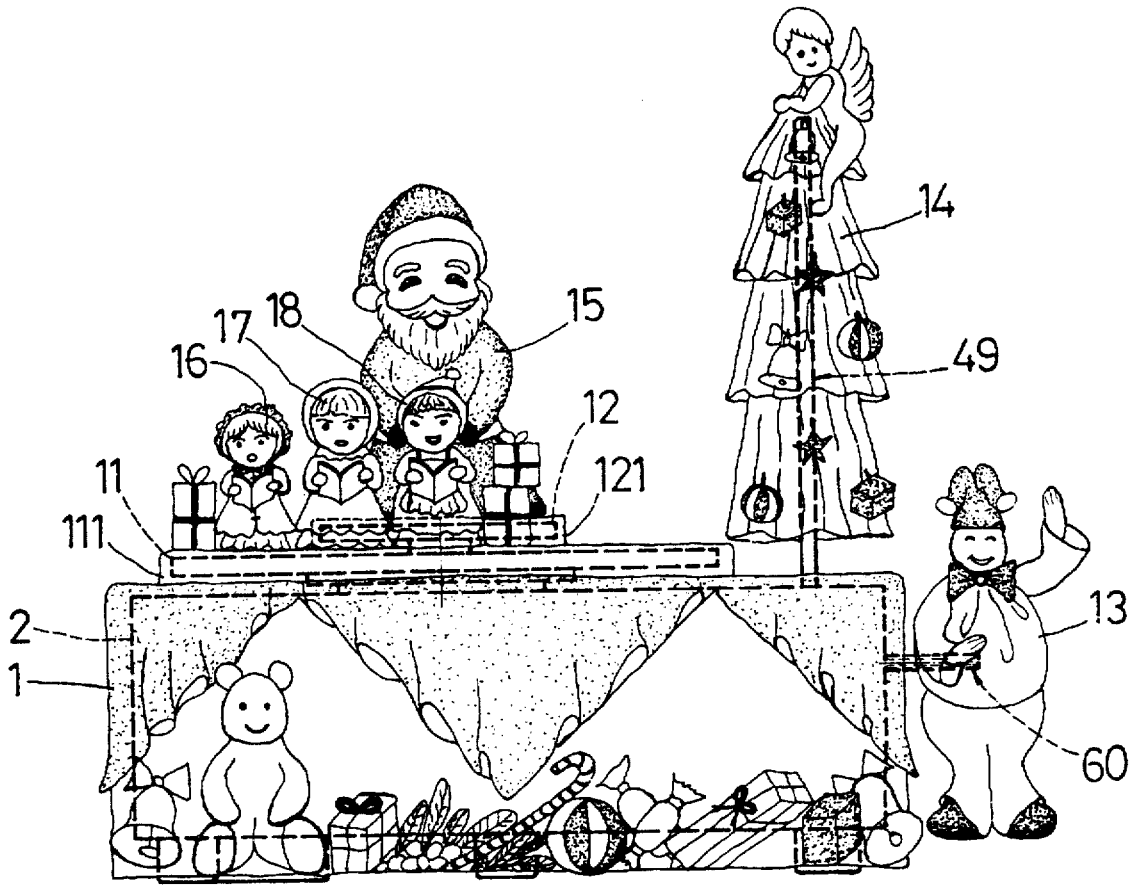
FIG. 1 is a front elevational view of a rotary toy of a preferred embodiment in accordance with the invention.
Figure 2:
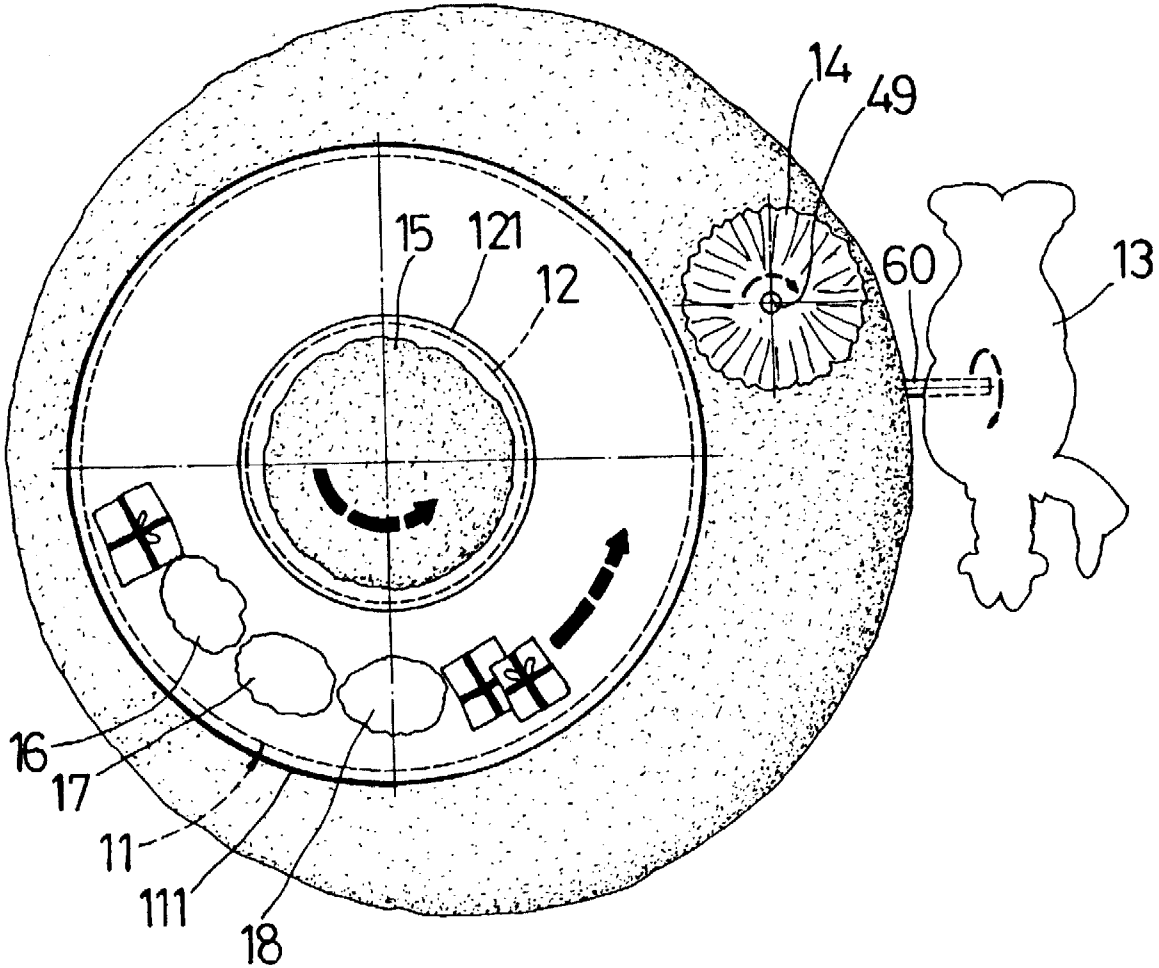
FIG. 2 is a top plan view of FIG. 1.
Figure 3:
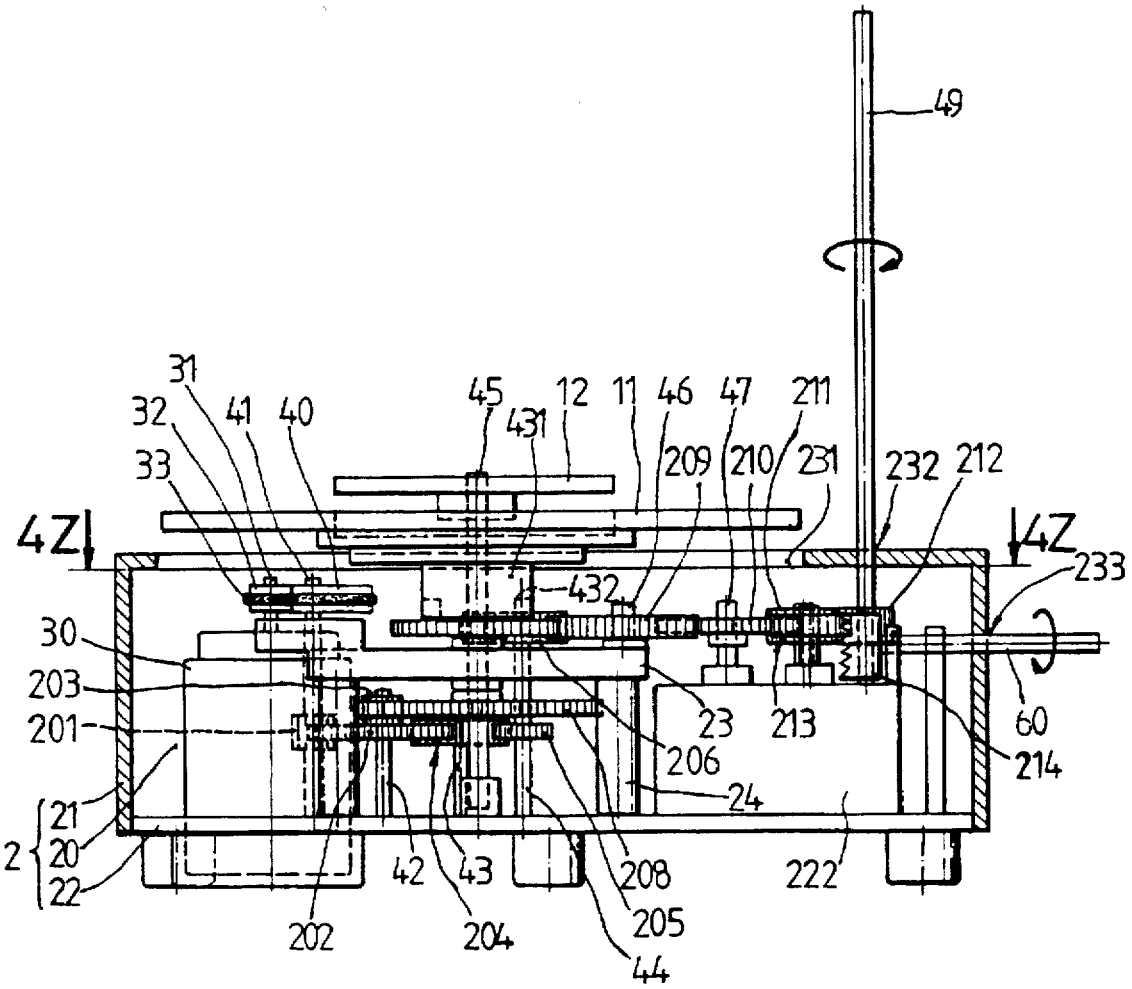
FIG. 3 is a side elevational view of a rotary mechanism of a preferred embodiment in accordance with the invention.
Figure 4:
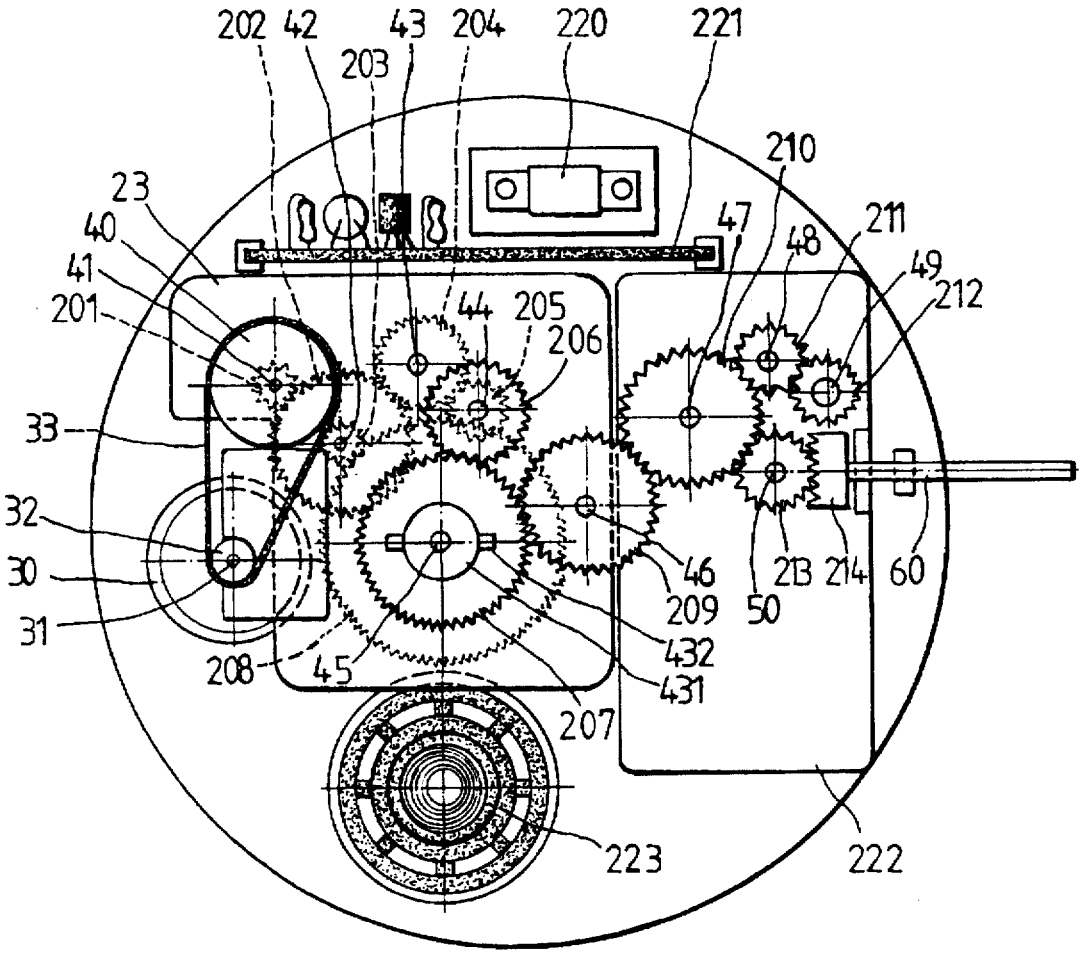
FIG. 4 is a top plan view of a rotary mechanism taken along line 4Z—4Z in FIG. 3.

Referring to FIGS. 1 to 3, a rotary toy comprises a spectacle shell 1, and a rotary mechanism 2 disposed in the spectacle shell 1. A first doll 13 is disposed on the outer periphery of the spectacle shell 1. A second doll 14 is disposed above the spectacle shell 1. A middle disk 11 is disposed on the spectacle shell 1. The middle disk 11 is enclosed by a middle disk casing 111. An upper disk casing 121 which encloses an upper disk 12 is disposed on the middle disk casing 111. A third doll 15 is disposed on the upper disk casing 121. A fourth, fifth and sixth dolls 16, 17 and 18 are disposed on the middle disk casing 111. The rotary mechanism 2 comprises a housing 21 which is covered by the spectacle shell 1, a base plate 22 disposed beneath the housing 21, and a gear set 20, an integrated circuit board 221 and a cell chamber 222 disposed in the interior between the base plate 22 and the housing 21.

Referring to FIGS. 1 to 4, the rotary mechanism 2 comprises a motor 30 disposed on the base plate 22, and a transverse plate 23 abutting a top of the motor 30 and supported by a plurality of posts 24 longitudinally. A switch 220, an integrated circuit board 221, a cell chamber 222 and a loudspeaker 223 are disposed on the base plate 22. The motor 30 has a driving shaft 31. A driving disk 32 is disposed on a top end of the driving shaft 31. A first, second, third, and fourth driven shafts 41, 42, 43, and 44 are extended upward from the base plate 22 longitudinally. A fifth and sixth driven shafts 45 and 46 are extended upward from the transverse plate 23 longitudinally. A seventh, eighth, ninth, and tenth driven shafts 47, 48, 49 and 50 are extended upward from the cell chamber 222 longitudinally. The eleventh driven shaft 60 is extended forward from the cell chamber 222 transversely. The first driven shaft 41 passes through the transverse plate 23. A driven disk 40 is disposed on a top end of the first driven shaft 41. A belt 33 surrounds the driving disk 32 and the first driven disk 40. A first pinion 201 is disposed at a middle portion of the first driven shaft 41. A first gear 202 is disposed at an upper portion of the second driven shaft 42. A second pinion 203 is disposed at a top end of the second driven shaft 42. A second gear 204 is disposed at a top end of the third driven shaft 43. The fourth driven shaft 44 passes through the transverse plate 23. A third pinion 205 is disposed at a middle portion of the fourth driven shaft 44. A third gear 206 is disposed at a top end of the fourth driven shaft 44. The fifth driven shaft 45 passes through a gear wheel 208, the transverse plate 23, a fourth gear 207, a driven cylinder 431, the middle disk 11, and the upper disk 12. Two inserted blocks 432 abut the driven cylinder 431. A fifth gear 209 is disposed at a top end of the sixth driven shaft 46. A sixth gear 210 is disposed at a top end of the seventh driven shaft 47. A seventh gear 211 is disposed at a top end of the eighth driven shaft 48. An eighth gear 212 is disposed at a lower portion of the ninth driven shaft 49. A ninth gear 213 is disposed at a top end of the tenth driven shaft 50. A tenth gear 214 is disposed at a rear end of the eleventh driven shaft 60. The housing 21 has a top opening 231 corresponding to the middle disk 11, a first through hole 232 to receive the ninth driven shaft 49, and a second through hole 233 to receive the eleventh driven shaft 60. The first doll 13 is supported by a front end of the eleventh driven shaft 60. The second doll 14 is supported by an upper portion of the ninth driven shaft 49. The first pinion 201 intermeshes with the first gear 202. The first gear 202 intermeshes with the second gear 204. The second gear 204 intermeshes with the third pinion 205. The third gear 206 intermeshes with the fourth gear 207. The gear wheel 208 intermeshes with the second pinion 203. The fourth gear 207 intermeshes with the fifth gear 209. The fifth gear 209 intermeshes with the sixth gear 210. The sixth gear 210 intermeshes with the seventh gear 211 and the ninth gear 213. The seventh gear 211 intermeshes with the eighth gear 212. The ninth gear 213 intermeshes with the tenth gear 214.

In operation, the driving disk 32 of the motor 30 drives the belt 33 to rotate the driven disk 40 and the first pinion 201. The first pinion 201 drives the first gear 202 and the second pinion 203 to rotate. The first gear 202 drives the second gear 204 to rotate. The second gear 204 drives the third pinion 205 and the third gear 206 to rotate. The third gear 206 drives the fourth gear 207 to rotate. The fourth gear 207 drives the fifth gear 209 to rotate. The fifth gear 209 drives the sixth gear 210 to rotate. The sixth gear 210 drives the seventh gear 211 and the ninth gear 213 to rotate. The seventh gear 211 drives the eighth gear 212 to rotate. The ninth gear 213 drives the tenth gear 214 to rotate. The first doll 13 rotates with the eleventh driven shaft 60 simultaneously. The second doll 14 rotates with the ninth driven shaft 49 simultaneously. The third doll 15 rotates with the upper disk casing 121 which is driven by the fifth driven shaft 45. The dolls 16, 17, and 18 rotates with the middle disk casing 111 simultaneously. The upper disk casing 121 rotates with the middle disk casing 111. The spectacle shell 1 does not rotate. The first doll 13 rotates transversely. The second doll 14 rotates longitudinally. It is an option to replace the dolls with toy houses, toy trees, and toy animals.

The invention is not limited to the above embodiment but various modification thereof may be made. Further, various changes in form and detail may be made without departing from the scope of the invention.

I claim:

1. A display having rotatable articles comprising:

a spectacle shell;

a first doll disposed on an outer periphery of said spectacle shell transversely;

a second doll disposed above said spectacle shell longitudinally;

a middle disk disposed on said spectacle shell;

said middle disk enclosed by a middle disk casing;

an upper disk casing disposed on said middle disk casing;

said upper disk casing enclosing an upper disk;

a third doll disposed on said upper disk casing;

at least a fourth doll disposed on said middle disk casing;

a rotary mechanism disposed in said spectacle shell;

said rotary mechanism comprising a housing which is covered by said spectacle shell, a base plate disposed beneath said housing, an integrated circuit board and a cell chamber disposed in an interior between said base plate and said housing, a motor disposed on said base plate, a transverse plate abutting a top of said motor and supported by a plurality of posts longitudinally; said posts extended upward from said base plate, said motor having a driving shaft, a driving disk disposed on a top end of said driving shaft; a first, second, third, and fourth driven shafts extended upward from said base plate longitudinally, a fifth and sixth driven shafts extended upward from said transverse plate longitudinally; a seventh, eighth, ninth, and tenth driven shafts extended upward from said cell chamber longitudinally, an eleventh driven shaft extended forward from said cell chamber transversely, said first driven shaft passing through said transverse plate, a first driven disk disposed on a top end of said first driven shaft, a belt surrounding said driving disk and said first driven disk, a first pinion disposed at a middle portion of said first driven shaft, a first gear disposed at an upper portion of said second driven shaft, a second pinion disposed at a top end of said second driven shaft, a second gear disposed at a top end of said third driven shaft, said fourth driven shaft passing through said transverse plate, a third pinion disposed at a middle portion of said fourth driven shaft, a third gear disposed at a top end of said fourth driven shaft, said fifth driven shaft passing through a gear wheel, said transverse plate, a fourth gear, a driven cylinder, said middle disk, said middle disk casing, said upper disk and said upper disk casing, a fifth gear disposed at a top end of said sixth driven shaft, a sixth gear disposed at a top end of said seventh driven shaft, a seventh gear disposed at a top end of said eighth driven shaft, an eighth gear disposed at a lower portion of said ninth driven shaft, a ninth gear disposed at a top end of said tenth driven shaft, and a tenth gear disposed at a rear end of said eleventh drive shaft;

said housing having a first through hole to receive said ninth driven shaft and a second through hole to receive said eleventh driven shaft;

said first doll supported by a front end of said eleventh driven shaft;

said second doll supported by an upper portion of said ninth driven shaft;

said first pinion intermeshing with said first gear;

said first gear intermeshing with said second gear;

said second gear intermeshing with said third pinion;

said third gear intermeshing with said fourth gear;

said gear wheel intermeshing with said second pinion;

said fourth gear intermeshing with said fifth gear;

said fifth gear intermeshing with said sixth gear;

said sixth gear intermeshing with said seventh gear and said ninth gear;

said seventh gear intermeshing with said eighth gear;

said ninth gear intermeshing with said tenth gear;

wherein said driving disk drives said belt to rotate said driven disk and said first pinion, said first pinion drives said first gear and said second pinion to rotate, said first gear drives said second gear to rotate, said second gear drives said third pinion and said third gear to rotate, said third gear drives said fourth gear to rotate, said fourth gear drives said fifth gear to rotate, said fifth gear drives said sixth gear to rotate, said sixth gear drives said seventh gear and said ninth gear to rotate, said seventh gear drives said eighth gear to rotate, said ninth gear drives said tenth gear to rotate, and said upper disk casing rotates with said middle disk casing.

* * * * *